US008863423B2

(12) United States Patent
Clifton, Jr. et al.

(10) Patent No.: US 8,863,423 B2
(45) Date of Patent: Oct. 21, 2014

(54) MAGAZINE BASE PAD

(71) Applicant: Prezine LLC, Jacksonville, FL (US)

(72) Inventors: Norman E. Clifton, Jr., Jacksonville, FL (US); William H. Rogers, St. Augustine, FL (US); Matthew E. McKendrick, Jacksonville, FL (US)

(73) Assignee: Prezine LLC, Jacksonville, FL (US)

( * ) Notice: Subject to any disclaimer, the term of this patent is extended or adjusted under 35 U.S.C. 154(b) by 0 days.

(21) Appl. No.: 13/920,431

(22) Filed: Jun. 18, 2013

(65) Prior Publication Data

US 2013/0333261 A1 Dec. 19, 2013

Related U.S. Application Data

(60) Provisional application No. 61/661,535, filed on Jun. 19, 2012.

(51) Int. Cl.
*F41A 9/65* (2006.01)

(52) U.S. Cl.
CPC ..... *F41A 9/65* (2013.01)
USPC ..... 42/50; 42/49.01

(58) Field of Classification Search
CPC ..... F41A 9/65; F41A 9/61; F41A 9/64
USPC ..... 42/50, 49.01, 49.02, 49.1, 7, 6, 11, 18, 42/17, 90, 94, 106, 96; 89/33.01–33.02, 89/33.1
See application file for complete search history.

(56) References Cited

U.S. PATENT DOCUMENTS

| | | | | |
|---|---|---|---|---|
| 3,143,819 | A * | 8/1964 | Stevens, Jr. | 42/50 |
| 3,377,732 | A * | 4/1968 | Bivens | 42/50 |
| 4,397,109 | A * | 8/1983 | Pachmayr et al. | 42/50 |
| 4,495,720 | A * | 1/1985 | Bross | 42/7 |
| 4,514,922 | A * | 5/1985 | Farrar et al. | 42/50 |
| 4,592,160 | A * | 6/1986 | Bross | 42/7 |

(Continued)

FOREIGN PATENT DOCUMENTS

WO 2012073052 A1 6/2012

OTHER PUBLICATIONS

Internal Search Report and the Written opinion of the International Searching Authority; Date of Mailing: Oct. 21, 2013 for International Patent Application No. PCT/US2013/046304; International Filing Date: Jun. 18, 2013: 9 pgs.

*Primary Examiner* — Daniel J Troy
*Assistant Examiner* — Joshua Freeman
(74) *Attorney, Agent, or Firm* — Cantor Colburn LLP

(57) ABSTRACT

A magazine includes a body member having a front, a back, and opposing side walls that define a first orifice at a first distal end of the body member, a retention plate member having a base, end wall, and retention spring portion, and a planar engagement surface extending from the base portion at an oblique angle relative to the base portion, wherein a portion of the front wall of the body member is disposed in a gap defined by the end wall portion and the retention spring portion, and an end plate member slidably engaging the body member, the end plate member having a base portion that defines an orifice having an engagement surface defining an oblique angle relative to the base portion, wherein the planar engagement surface of the retention plate member is disposed in the orifice in contact with the planar engagement surface of the end plate member.

2 Claims, 10 Drawing Sheets

(56) References Cited

U.S. PATENT DOCUMENTS

| | | | | |
|---|---|---|---|---|
| 4,862,619 | A * | 9/1989 | Baldus et al. | 42/7 |
| 5,438,783 | A | 8/1995 | Sniezak et al. | |
| D362,044 | S * | 9/1995 | Sniezak | D22/108 |
| 5,526,600 | A * | 6/1996 | Chesnut et al. | 42/50 |
| 5,651,204 | A * | 7/1997 | Hulsey et al. | 42/50 |
| 5,666,752 | A | 9/1997 | Grams | |
| 6,568,115 | B2 | 5/2003 | Beretta | |
| D487,791 | S * | 3/2004 | Freed | D22/108 |
| 7,093,386 | B1 * | 8/2006 | Vieweg | 42/7 |
| 7,200,963 | B1 * | 4/2007 | Vieweg | 42/49.01 |
| 7,509,767 | B2 * | 3/2009 | Bolen | 42/50 |
| 7,797,871 | B2 * | 9/2010 | Bubits | 42/49.01 |
| 7,908,780 | B2 | 3/2011 | Fitzpatrick et al. | |
| 8,191,297 | B2 * | 6/2012 | Gwillim, Jr. | 42/1.02 |
| 8,590,203 | B1 * | 11/2013 | McCarthy et al. | 42/96 |
| 8,607,489 | B1 * | 12/2013 | Calvert | 42/49.01 |
| 8,635,796 | B2 * | 1/2014 | Fitzpatrick et al. | 42/50 |
| 8,671,606 | B2 * | 3/2014 | Plataniotis et al. | 42/6 |
| 2002/0029506 | A1 * | 3/2002 | Wollmann | 42/50 |
| 2011/0005113 | A1 * | 1/2011 | Fitzpatrick et al. | 42/1.02 |
| 2011/0030257 | A1 * | 2/2011 | Gwillim, Jr. | 42/1.02 |
| 2011/0302816 | A1 * | 12/2011 | Fitzpatrick et al. | 42/50 |
| 2013/0019511 | A1 * | 1/2013 | Plataniotis et al. | 42/6 |
| 2013/0227870 | A1 * | 9/2013 | Rendulic | 42/50 |
| 2014/0020275 | A1 * | 1/2014 | Corso | 42/49.01 |
| 2014/0047751 | A1 * | 2/2014 | Lee | 42/49.01 |

* cited by examiner

MAGAZINE BASE PAD

BACKGROUND

The present invention relates to firearms magazines, and more specifically, to base plates of firearm magazines.

Numerous firearms use a magazine that stores and feeds cartridges into the chamber of the firearm. A typical magazine includes a tubular or "box" shaped body member with a follower member biased by a magazine spring. The magazine spring exerts an expansive force on the follower member and an opposing base member of the magazine.

In operation, a succession of cartridges may be loaded into the magazine by applying a compressive force on the magazine spring. The firearm successively removes cartridges from the magazine and feeds the cartridges into the chamber of the firearm. As a cartridge is removed from the magazine, the expansive force exerted by the magazine spring drives the follower and the succession of cartridges such that another cartridge in the succession is positioned to be chambered by the firearm.

SUMMARY

According to one embodiment of the present invention, a magazine includes a body member having a front wall, a back wall, and opposing side walls that define an inner cavity having a first orifice at a first distal end of the body member, a retention plate member having a base portion, an end wall portion, a retention spring portion, and a planar engagement surface extending from the base portion at an oblique angle relative to the base portion, wherein a portion of the front wall of the body member is disposed in a gap defined by the end wall portion and the retention spring portion, an end plate member slidably engaging the body member, the end plate member having a base portion that defines an orifice having an engagement surface defining an oblique angle relative to the base portion, wherein the planar engagement surface of the retention plate member is disposed in the orifice in contact with the planar engagement surface of the end plate member.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
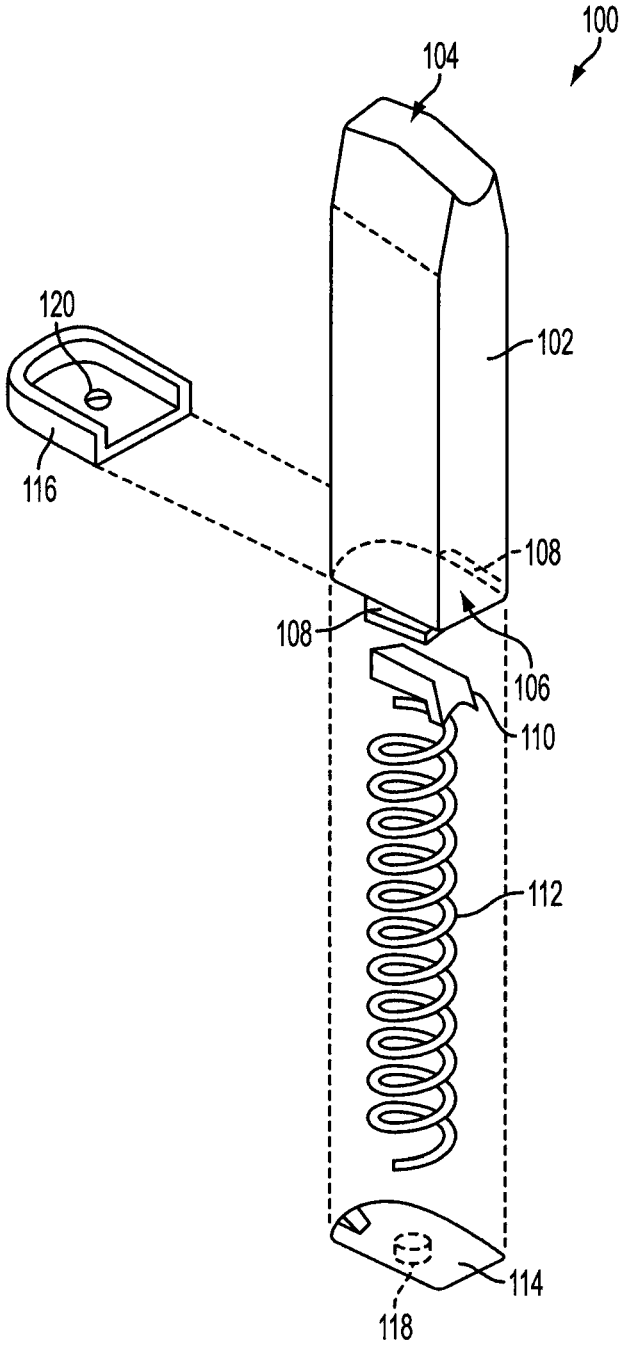
FIG. 1 PRIOR ART
FIG. 1 illustrates a prior art example of a firearm magazine.

FIG. 1 illustrates a prior art example of a firearm magazine (magazine) 100. The magazine 100 includes a body portion 102 having opposing orifices 104 and 106. Flanges 108 are arranged proximate to the orifice 106 and extend outwardly from the body portion 102. A follower member 110, magazine spring 112, and floor plate 114 are arranged in the interior cavity of the body portion 102. A butt plate 116 slidably engages the flanges 108 with corresponding groves (not shown). When assembled, the follower member 110, magazine spring 112, and floor plate 114 are disposed in the body portion 102 such that the follower member 110 is proximate to the orifice 104. The follower member 110 and the region of the body portion 102 proximate to the orifice 104 are sized and shaped such that the follower member 110 is impeded from passing through the orifice 104. A compressive force is applied to the magazine spring 112 such that the floor plate 114 is disposed in the body portion 102. The butt plate 116 is slid into position while engaged with the flanges 108 to retain the follower member 110, magazine spring 112, and floor plate 114 in the body portion 102. The floor plate 114 includes a tabular or pin shaped retention portion 118 extending outwardly from the body portion 102 that engages a corresponding orifice 120 defined by the butt plate 116. In assembly, the magazine spring 112 may be compressed to provide clearance that allows the butt plate 116 to be positioned on the body portion 102 without substantial impediment by the retention portion 118. The expansive force of the magazine spring 112 affects the engagement of the retention portion 118 with the orifice 120 of the butt plate 116, while the flanges 108 oppose the expansive force of the magazine spring 112 to retain the butt plate 116 in the assembly. Interference provided by the retention portion 118 engaging the orifice 120 of the butt plate 116 is intended to prevent the butt plate 116 from being slidably removed from the assembly. Once assembled, a succession of cartridges (not shown) may be fed into the magazine 100 via the orifice 104 by compressing the magazine spring 112 while depressing the follower member, which travels in the interior cavity of the body portion 102. The succession of cartridges is retained by, for example, tabular features (not shown) arranged proximate to the orifice 104.

The secure assembly of the magazine 100 relies on the bias provided by the magazine spring 112. Thus, if the magazine spring 112 is compressed by, for example, a shock due to an impact of the magazine butt plate 116 on a rigid surface, the retention portion 118 may disengage from the orifice 120 of the butt plate 116. The disengagement may result in the butt plate 116 sliding out of alignment and, in some instances, being completely removed from the magazine 100. Such an occurrence renders the magazine 100 inoperable.

The exemplary embodiments described below provide a magazine with a base pad that is retained on a body portion of the magazine with features that overcome the deficiencies of the prior art magazine 100 described above.

Figure 2:
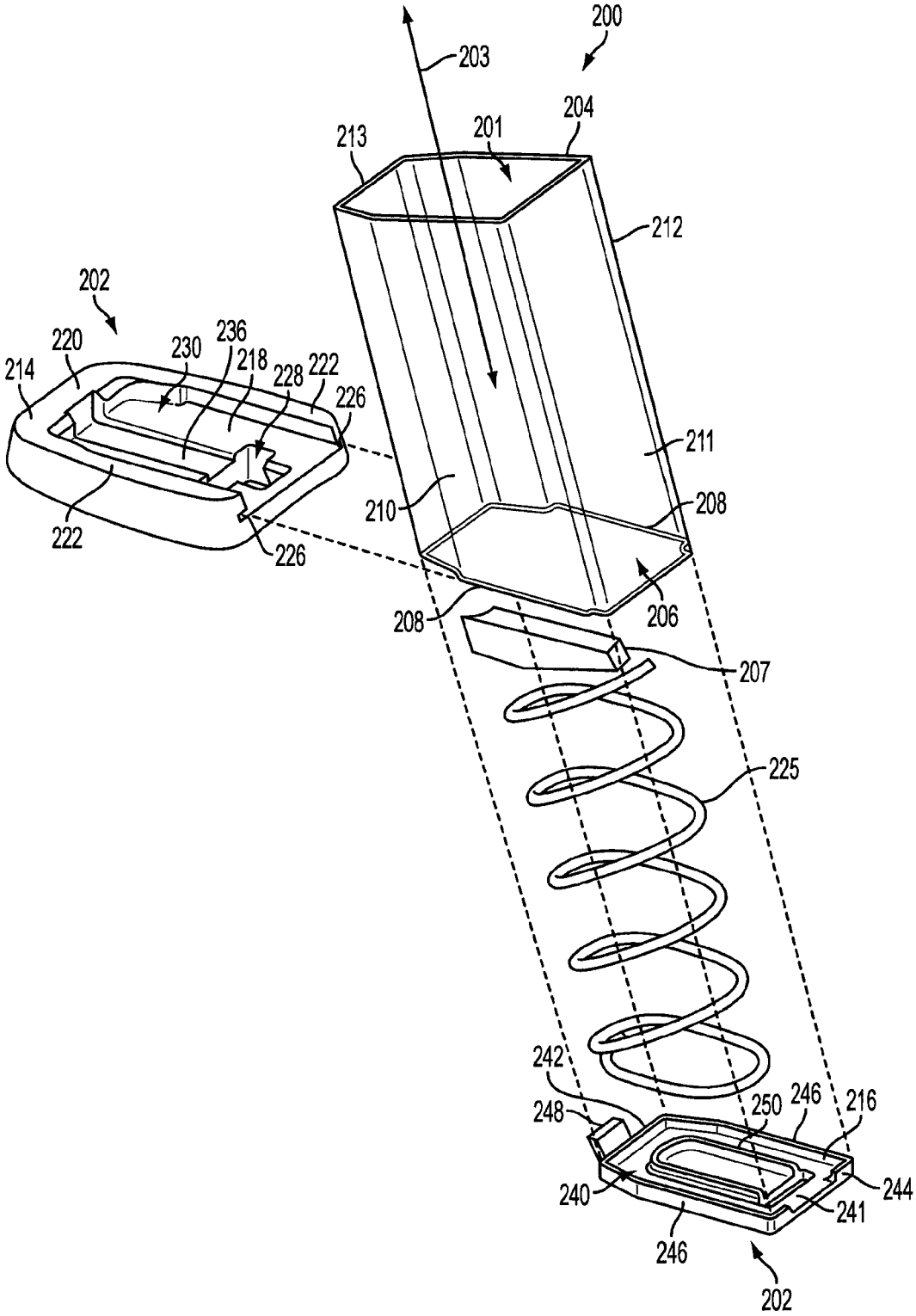
FIGS. 2 and 3 illustrate exploded perspective views of a portion of a magazine and end plate assembly.
Figure 3:
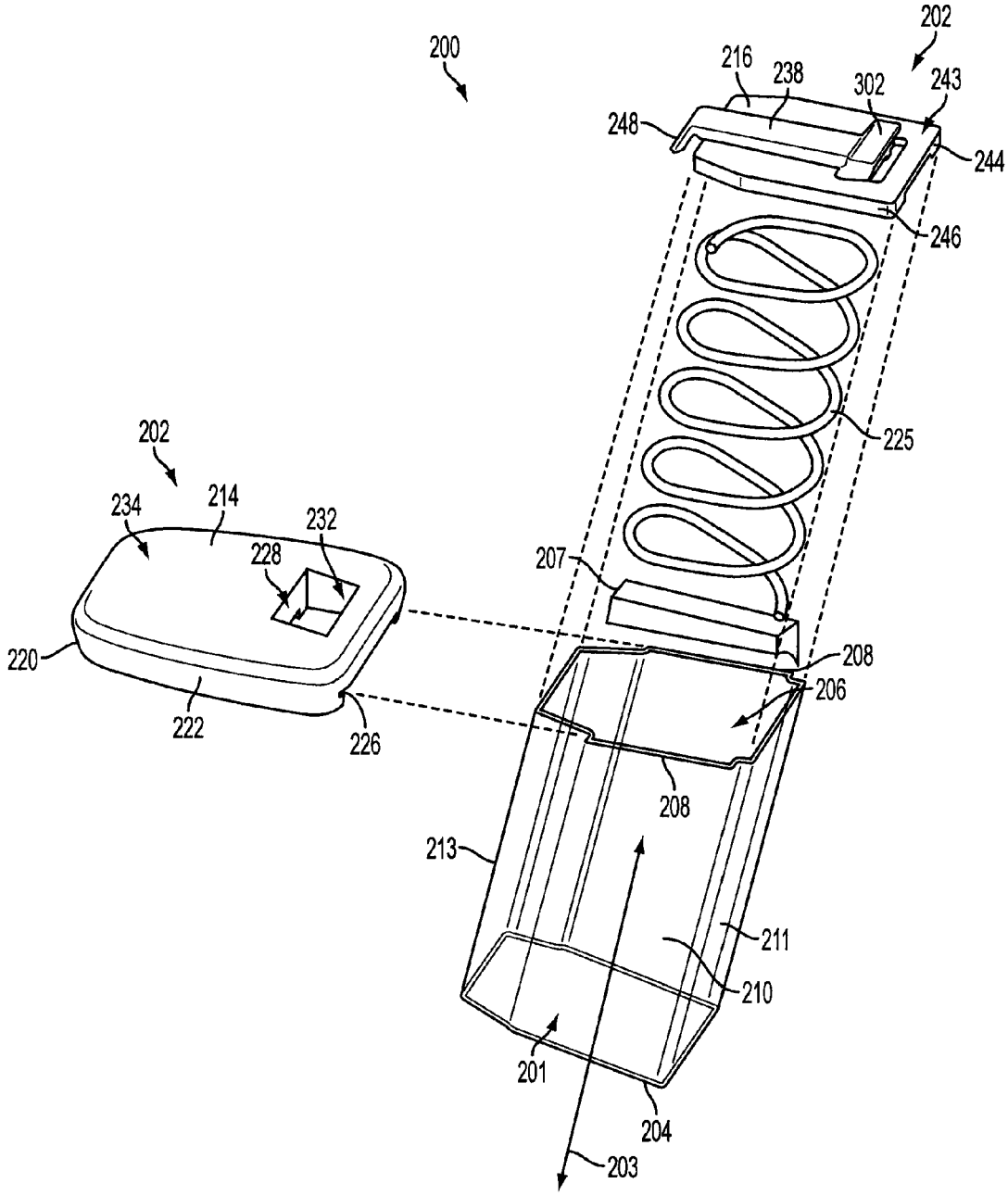

In this regard, FIGS. 2 and 3 illustrate exploded perspective views of a portion of a magazine 200 having a follower 207, magazine spring 225, and end plate assembly 202. FIG. 2 illustrates a lower portion of the magazine 200. An upper portion of the magazine 200 may have any suitable profile and dimensions that define an orifice operative to receive cartridges (not shown) and interfere with the travel of the follower 207. The magazine 200 includes a body member 204 having opposing side walls 210 and 212, a back wall 211 and a front wall 213 defining an inner cavity 201. The body member 204 defines a first orifice 206 arranged at a first distal end of the body member 204 and a second orifice (not shown) opposing the first orifice 206 arranged at a second distal end of the body member 204. The body member 204 defines a longitudinal axis illustrated by the line 203. The body portion includes flanges 208 arranged proximate to the first orifice 206 that extend outwardly from the opposing sidewalls 210 and 212 respectively.

Figure 4:
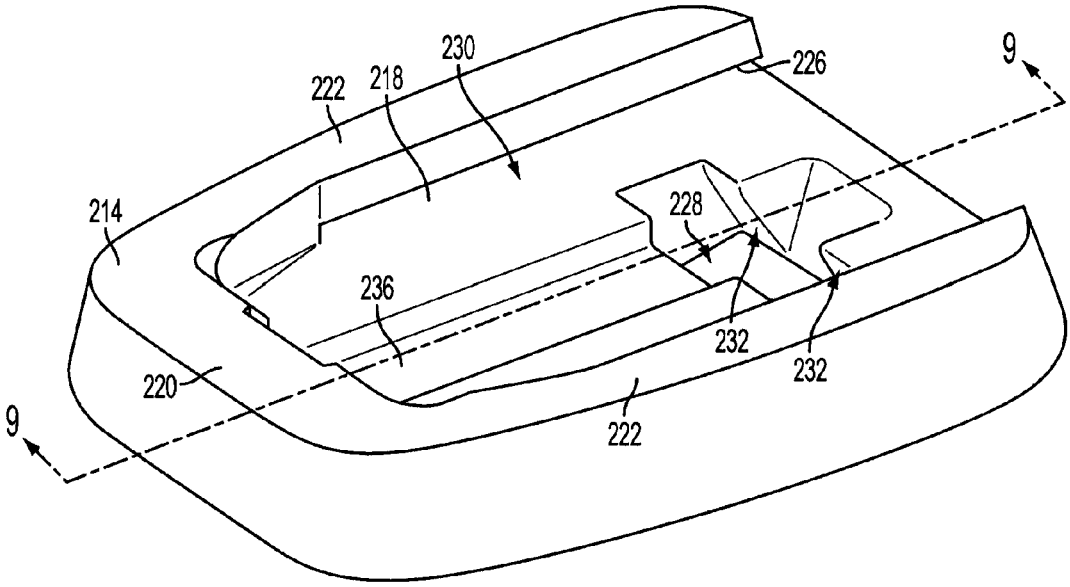
FIGS. 4 and 5 illustrate perspective views of the end plate member.
Figure 5:
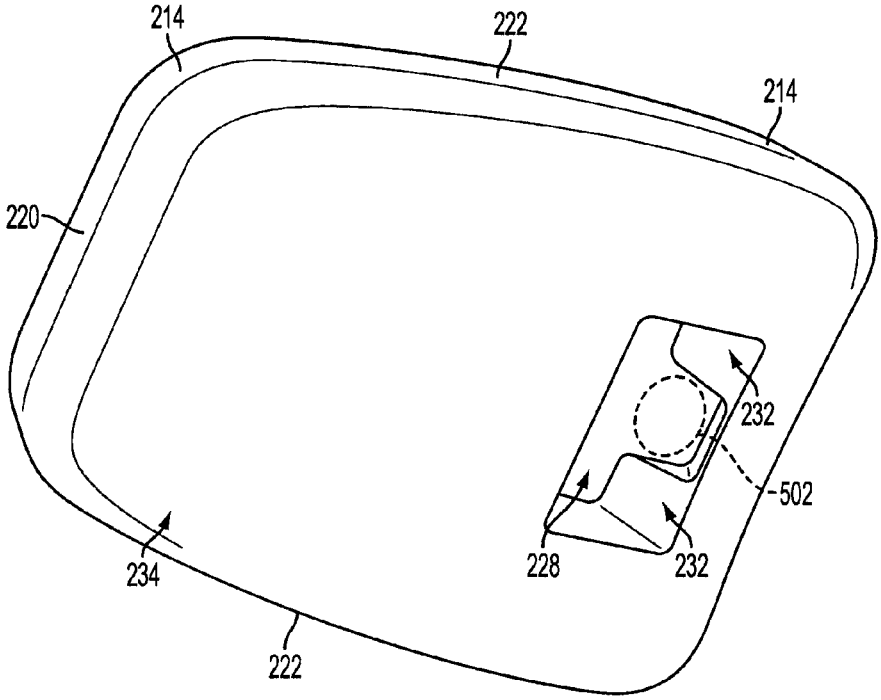
Figure 6:
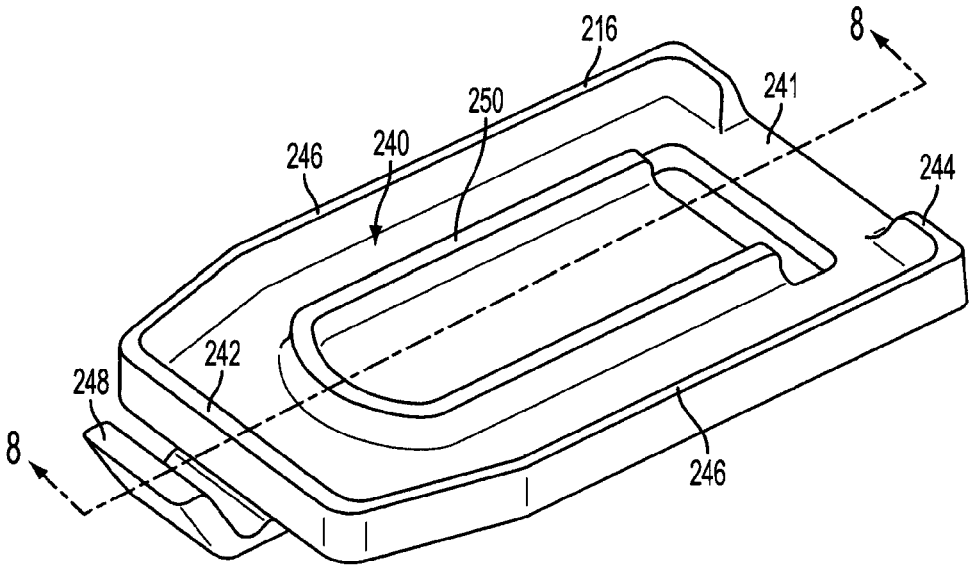
FIGS. 6 and 7 illustrate perspective views of the retention plate member of the end plate assembly.
Figure 7:
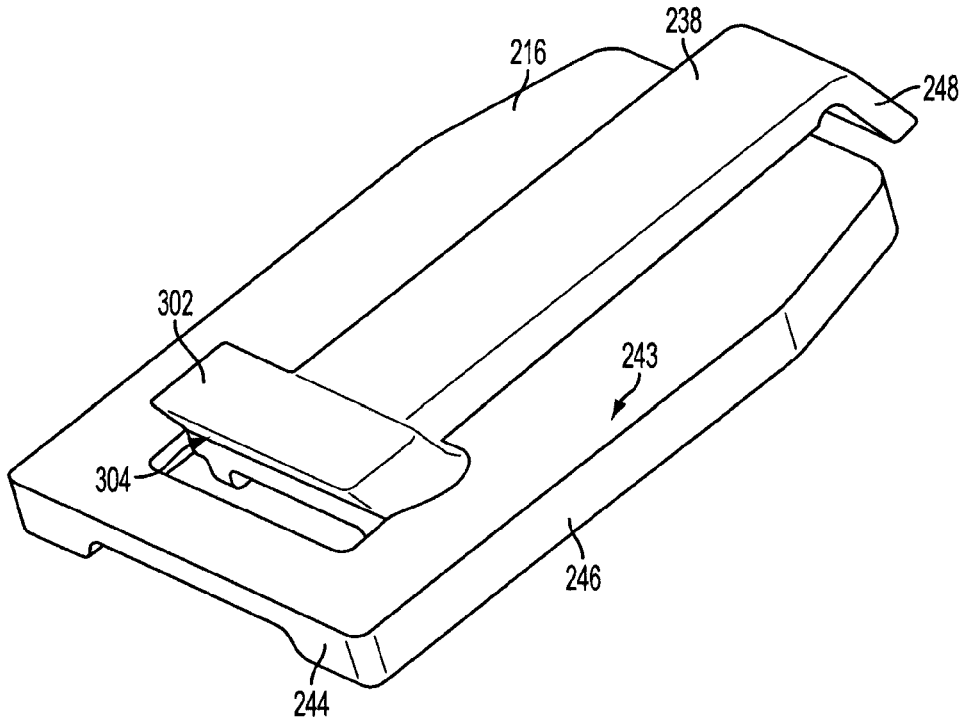

FIGS. 4 and 5 illustrate perspective views of the end plate member 214 and FIGS. 6 and 7 illustrate perspective views of the retention plate member 216 of the end plate assembly 202. The end plate member 214 includes a base portion 218, an end wall portion 220, and sidewalls 222. The end wall portion 220 and the sidewalls 222 extend upwardly at right angles generally from the perimeter of the base portion 218. The base portion 218 and portions of the sidewalls 222 define grooves 226 that extend longitudinally along the sidewalls 222. The grooves 226 are operative to slidably engage the flanges 208 of the body member 204 to substantially retain the end plate member 214 on the body member 204. The grooves 226 terminate proximate to the end wall portion 220 such that the end wall portion 220 impedes the travel of the end plate member 214 when the end plate member is fully engaged with the body member 204.

The end plate member 214 includes an orifice 228 having engagement surfaces 232 arranged at an oblique angle relative to planar surface 230 of the base portion 218. The orifice 228 is communicative with the planar surface 230 and an opposing bottom surface 234 of the end plate member 214. The engagement surfaces 232 define an access region 502 arranged therebetween.

In the illustrated embodiment, the end plate member 214 includes a channel 236 defined by the base portion 218 and a portion of the end wall portion 220 that corresponds to a longitudinal protrusion 238 arranged on a surface of the retention plate member 216 that will be described in further detail below.

Referring to FIGS. 6 and 7, the retention plate member 216 includes base portion 241 having a first surface 240 and an opposing second surface 243. When assembled, portions of the opposing second surface 243 contact the planar surface 230 of the end plate member 214 (of FIG. 4). The retention plate member 216 includes an end wall 242 an opposing front wall 244 and side walls 246 that extend upwardly at right angles to the base portion 241 arranged generally around the perimeter of the base portion 241.

In the illustrated embodiment, the retention plate member 216 includes a retention spring portion 248 that extends outwardly from the retention plate member proximate to the end wall 242. The illustrated embodiment includes a magazine spring alignment portion 250 arranged on the first surface 240 of the base portion 241. The magazine spring alignment portion 250 is sized and shaped to align the magazine spring 225 (of FIG. 2) with the retention plate member 216. Though the illustrated embodiment includes the magazine spring alignment portion 250, the magazine spring alignment portion 250 may be optional in alternate embodiments.

Referring to FIG. 7, the retention plate member 216 includes a retention engagement portion 302 having a planar engagement surface 304 that extends from the second surface 243. The planar engagement surface 304 is arranged at an oblique angle relative to the second surface 243. When assembled the planar engagement surface 304 contacts the engagement surfaces 232 of the end plate member 214 as will be described in further detail below.

Figure 8:
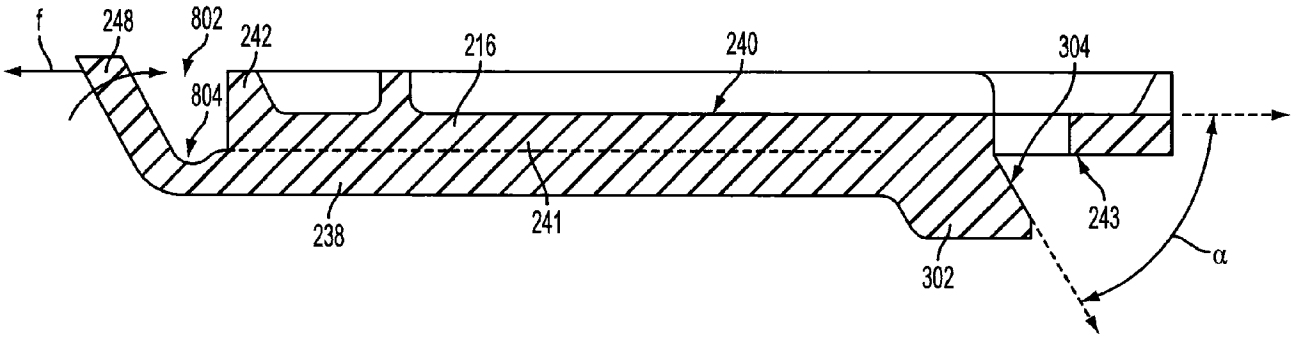
FIG. 8 illustrates a side cross-sectional view of the retention plate member along the line 8 of FIG. 6.
Figure 9:
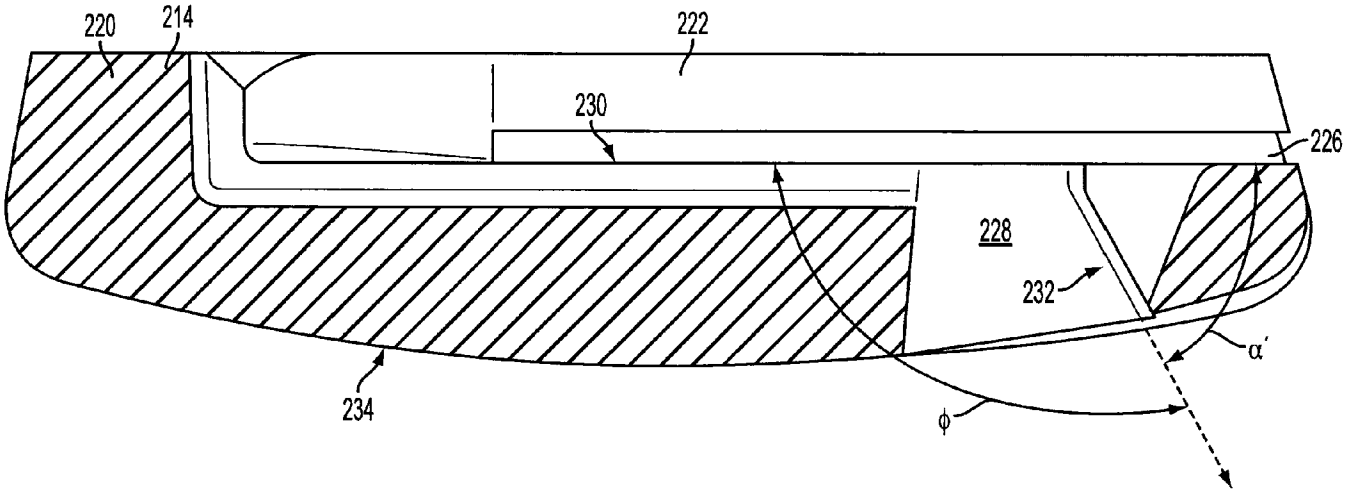
FIG. 9 illustrates side cross-sectional view of the end plate member along the line 9 of FIG. 4.
Figure 10:
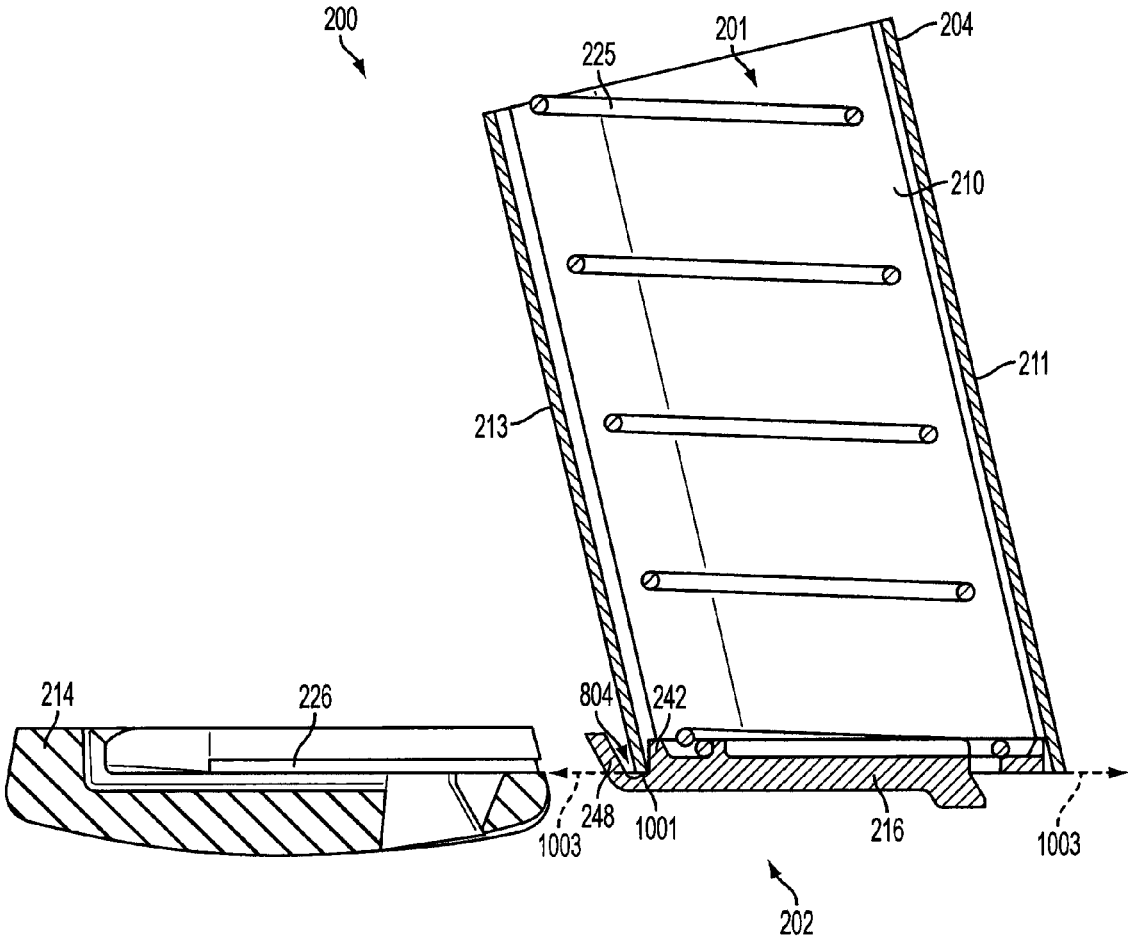
FIGS. 10, 11, 12 and 13 illustrate side cut-away views showing an exemplary method of assembling the end plate assembly 202 of the magazine 200.

FIGS. 8 and 9 illustrate side cross-sectional views of the retention plate member 216 and the end plate member 214 along the lines 8 (of FIGS. 6) and 9 (of FIG. 4) respectively. Referring to FIG. 8, the planar engagement surface 304 of the retention plate member 216 and the first surface 240 of the base portion 241 define an oblique angle ($\alpha$) that may range from, for example, approximately 2° to 88°. In the illustrated embodiment the angle $\alpha$ is approximately 60°. Referring to FIG. 9, the planar surface 230 and the engagement surfaces 232 of the end plate member 214 define an oblique angle ($\phi$) that may range from, for example, approximately 2° to 88°. In the illustrated embodiment the angle $\phi$ is approximately 60°. Though the illustrated embodiment includes angles $\alpha$ and $\phi$ that are substantially similar, alternate embodiments may include angles $\alpha$ and $\phi$ that are dissimilar if desired.

Referring to FIG. 8, the end wall 242 and retention spring portion 248 of the retention plate member 216 define a gap 802 therebetween. The retention spring portion 248 extends outwardly from the longitudinal protrusion 238 such that a concave surface 804 is arranged below the second surface 243 of the base portion 241. The retention spring portion 248 is semi-rigid and operative to be deflected proximate to the concave surface 804 when a force is applied to the retention spring portion 248 and provides an biasing force (f) opposing such deflection.

FIGS. 10-13 illustrate side cut-away views showing an exemplary method of assembling the end plate assembly 202 of the magazine 200. In this regard, referring to FIG. 10, the follower (not shown), magazine spring 225, and retention plate member 216 are arranged in the inner cavity 201 of the body member 204. The retention plate member 216 is arranged such that the end wall 242 contacts the inner surface of the front wall 213 of the body member 204. The concave surface 804 of the retention spring portion 248 contacts an edge 1001 of the end wall 242. A portion of the front wall 213 of the body member 204 is arranged in the gap 802 between the end wall 242 and retention spring portion 248 of the retention plate member 216. The planar engagement surface 304 of the retention plate member 216 is arranged below a plane 1003 defined by the edges of the distal end of the body member 204 such that at least a portion of the planar engagement surface 304 is arranged outside of the inner cavity 201.

Figure 11:
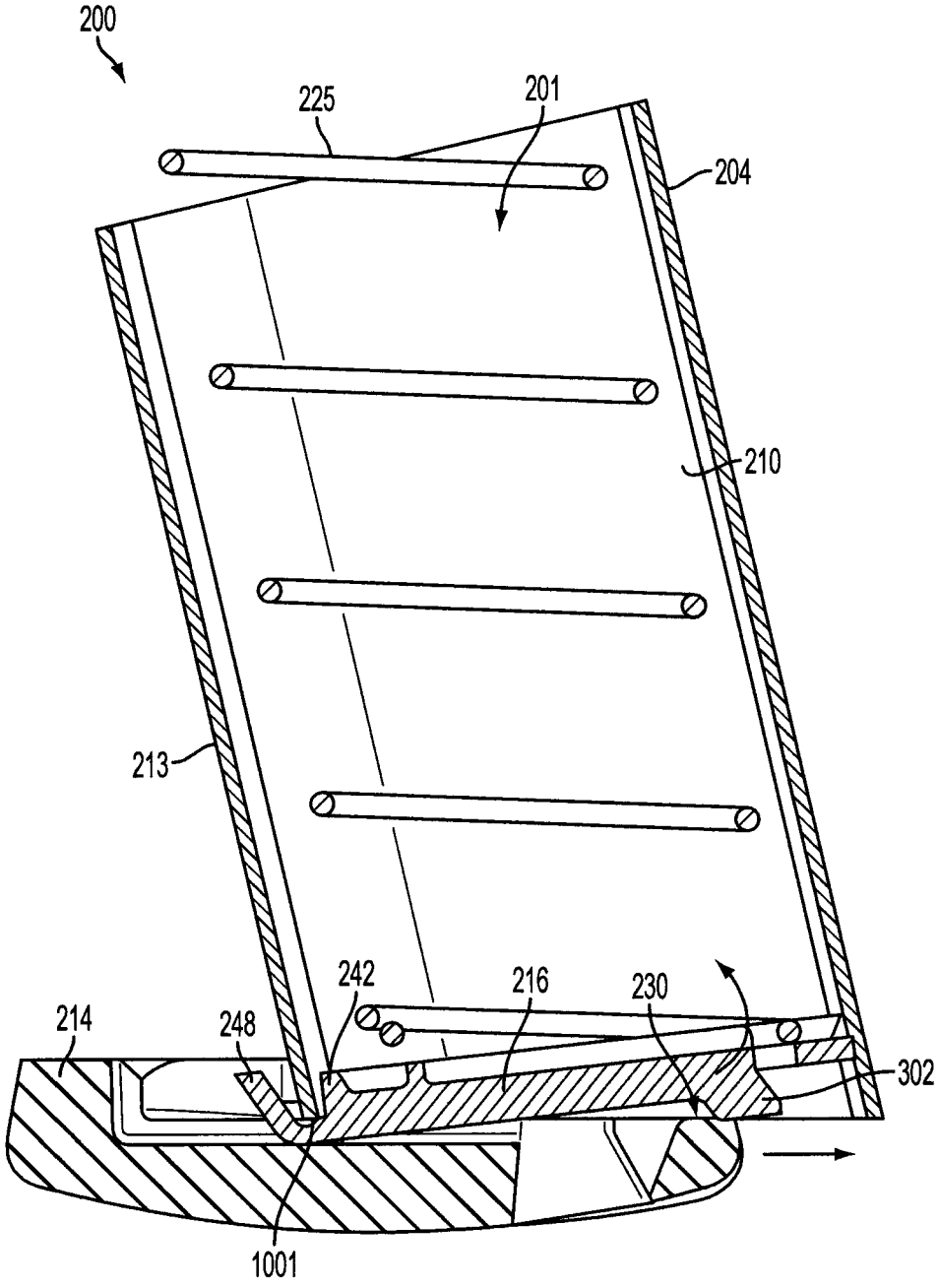

Referring to FIG. 11, the end plate member 214 slidably engages the body member 204 by aligning the grooves 226 (see FIG. 10) with the flanges 208 (see FIG. 2) and sliding the flanges 208 into the grooves 226. The end plate member 214 contacts the retention engagement portion 302 of the retention plate member 216 and urges a portion of the retention plate member 216 into the inner cavity 201. The retention plate member 216 is substantially retained by interference provided by the retention spring portion 248 and the front wall 213 of the body member 204. The curved profile of the retention spring portion 248 provides a pivot region proximate to the edge 1001 of the front wall 213 such that the retention engagement portion 302 of the retention plate member 216 may be encouraged to contact the planar surface 230 of the end plate member 214.

Figure 12:
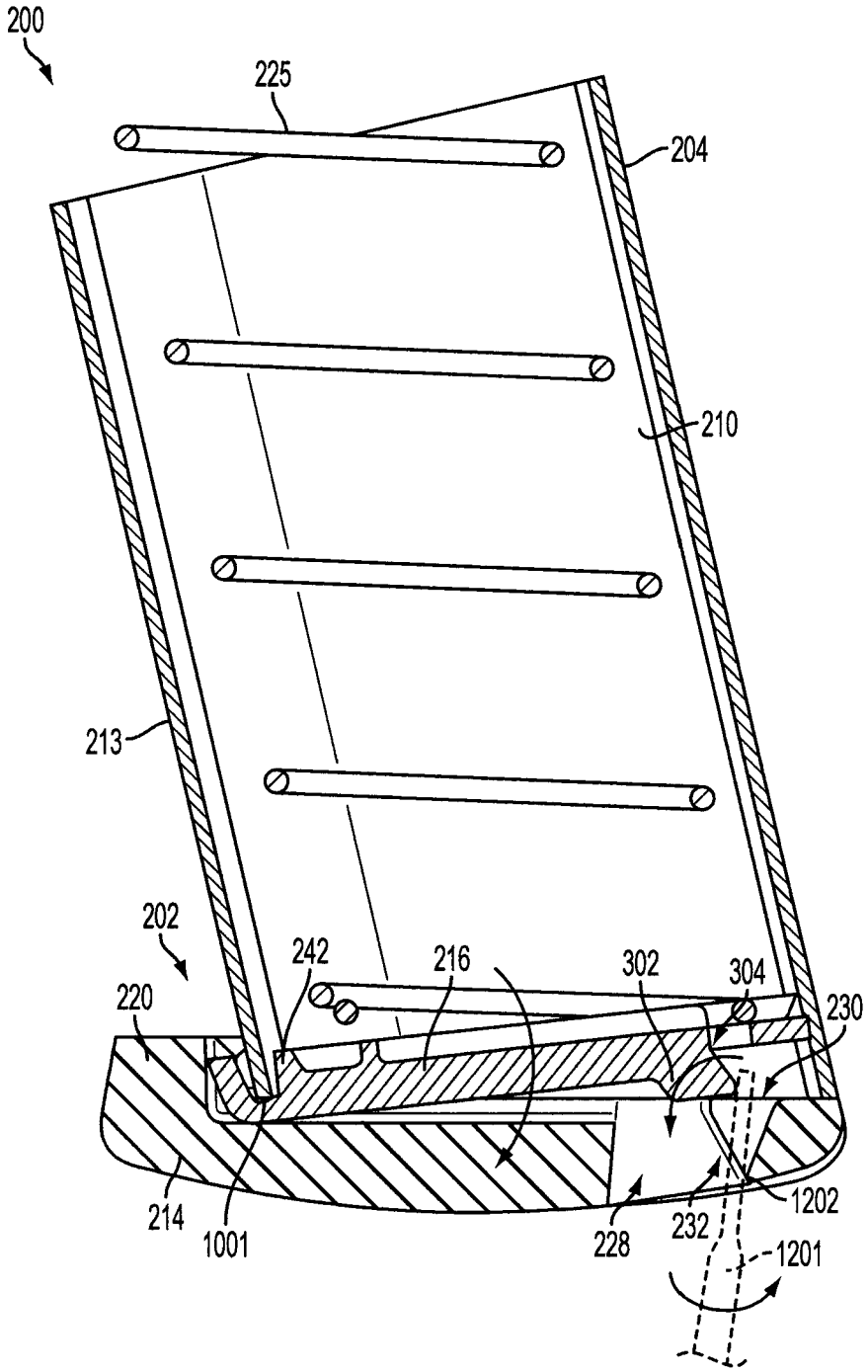

Referring now to FIG. 12, the end plate member 214 is disposed substantially in a fully engaged position such that the retention spring portion 248 is deflected by the end wall portion 220. The retention engagement portion 302 of the retention plate member 216 is arranged in contact with the planar surface 230 of the end plate member 214. A tool 1201 such as, for example, a screw driver or other tool operative to provide a leverage force is inserted into the orifice 228 in a gap partially defined by the engagement surfaces 232. The tool 1201 contacts a pivot region 1202 of the end plate member 214 and a portion of the retention engagement portion 302. A torsional force applied to the tool 1201 about the pivot region 1202 urges the retention engagement portion 302 into the orifice 228 such that the planar engagement surface 304 of the retention plate member 216 contacts the engagement surfaces 232 of the end plate member 214. When the torsional force is applied to the tool 1201, the interference of the end wall 242 of the retention plate member 216 with the front wall 213 of the body member 204 provides an opposing force such that the retention plate member 216 is deflected and pivots about the edge 1001 of the front wall 213 of the body member 204.

Though the illustrated embodiment shows the use of the tool 1201 to assist assembly, the magazine 200 may be assembled without tools by, for example, exerting a sharp force or blow to the end wall portion 220 of the end plate member 214. Such a force may drive the retention engagement portion 302 into alignment with the orifice 228 while the expansive force of the magazine spring 225 assists in urging the retention engagement portion 302 into the orifice 228 such that the planar engagement surface 304 of the retention plate member 216 contacts the engagement surfaces 232 of the end plate member 214.

Figure 13:
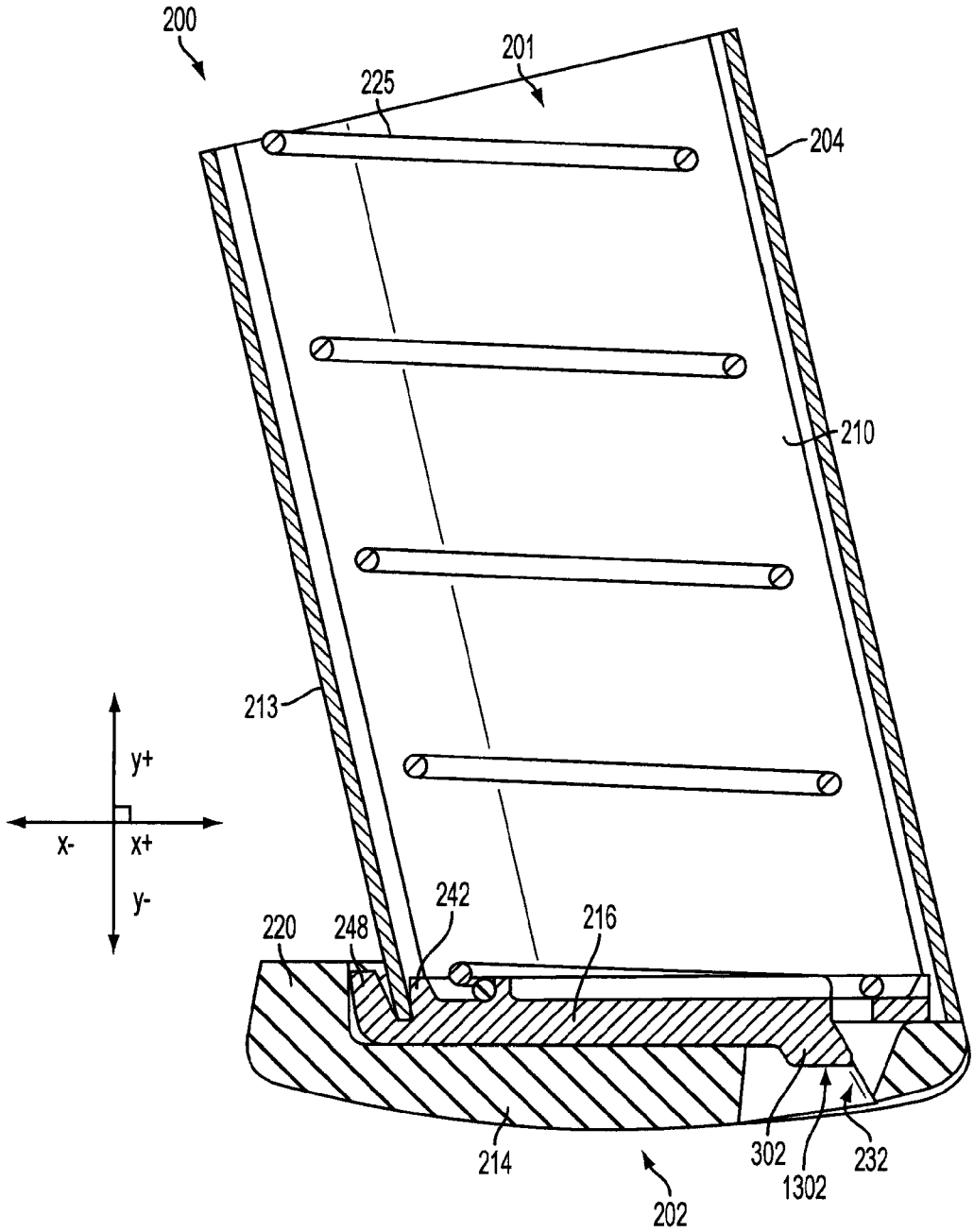

Referring to FIG. 13, the magazine 200 is shown assembled with the end plate 202 assembly, the body member 204, the magazine spring 225, and the follower (not shown). The end plate assembly 202 is retained on the distal end of the body member 204 and provides an opposing force to the compressed magazine spring 225. However, the end plate assembly 202 is not reliant on the expansive force of the magazine spring 225 to remain assembled or engaged with the body member 204. Indeed, the magazine spring 225 may be completely removed from the magazine 200, and the end plate assembly 202 will remain assembled and engaged with the body member 204.

In this regard still referring to FIG. 13, the flanges 208 (of FIG. 2) engaged with the grooves 226 retain the end plate 202 assembly along the y-axis and oppose the expansive force of the magazine spring 225 (and forces applied in the positive and negative directions along the y-axis). The front wall 213 of the body member 204 interferes with the end wall portion 220 of the end plate member 214 such that a force applied in the positive direction of the x-axis will not disengage the end plate assembly from the body member 204. If a force is applied to the end plate member 214 in the negative direction of the x-axis, the interference between the retention engagement portion 302 and the engagement surface 232 will apply force to the retention plate member 216. The force applied to the retention plate member 216 is opposed by the interference between the end wall of the retention plate member 216 and the back wall of the body member 204. Forces applied along a z-axis (not shown) orthogonal to the plane defined by the x-axis and y-axis are opposed by the interference between the opposing side walls 222 (of FIG. 2) of the end plate member 214 and the opposing side walls 210 of the body member 204. The oblique angles $\alpha$ and $\phi$ (of FIGS. 8 and 9) of the planar engagement surface 304 of the retention plate member 216 and the engagement surfaces 232 of the end plate member 214 provide an interference that impedes the retention plate member 216 from disengaging the end plate member 214.

The retention plate member 216 may be disengaged from the end plate member 214 if desired (e.g., for maintenance or repair) by, for example, inserting the tool 1201 (of FIG. 12) or another object such as, a user's finger or a point of a bullet into the orifice 228 and applying a force substantially along the y-axis in the positive direction to the exposed surface 1302 of the retention engagement portion 302. The force is operative to deflect the retention plate member 216 and compress the retention spring portion 248 such that the retention plate member 216 is disposed in a position substantially similar to the arrangement illustrated and described above in FIG. 12. The magazine 200 may be disassembled by removing the end plate member 214 by sliding the end plate member 214 from the body member 204.

The technical effects and benefits of the embodiments described above, provide a magazine 200 having an end plate assembly 202 that is secured to the body member 204 of the magazine 200 using mechanical interference. The end plate assembly 202 remains assembled and engaged with the body member 204 regardless of whether an expansive force is provided by the magazine spring 225 on the end plate assembly 202.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A magazine comprising:

a body member having a front wall, a back wall, and opposing side walls that define an inner cavity having a first orifice at a first distal end of the body member;

a retention plate member having a base portion, an end wall portion, a retention spring portion, and a planar engagement surface extending from the base portion at an oblique angle relative to the base portion, wherein a portion of the front wall of the body member is disposed in a gap defined by the end wall portion and the retention spring portion;

an end plate member slidably engaging the body member, the end plate member having a base portion that defines an orifice having an engagement surface defining an oblique angle relative to the base portion, wherein the planar engagement surface of the retention plate member is disposed in the orifice in contact with the engagement surface of the end plate member.

2. The magazine of claim 1, wherein the magazine further comprises a follower member and a magazine spring arranged in the inner cavity of the body portion.

* * * * *